US010174731B2

(12) United States Patent
Schmidbauer

(10) Patent No.: US 10,174,731 B2
(45) Date of Patent: Jan. 8, 2019

(54) HIGH PRESSURE PUMP FOR A FUEL INJECTION SYSTEM OF AN INTERNAL COMBUSTION ENGINE

(71) Applicant: Continental Automotive GmbH, Hannover (DE)

(72) Inventor: Thomas Schmidbauer, Falkenstein (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

(21) Appl. No.: 15/119,165

(22) PCT Filed: Oct. 7, 2015

(86) PCT No.: PCT/EP2015/073114
§ 371 (c)(1),
(2) Date: Aug. 16, 2016

(87) PCT Pub. No.: WO2016/058878
PCT Pub. Date: Apr. 21, 2016

(65) Prior Publication Data

US 2017/0211534 A1 Jul. 27, 2017

(30) Foreign Application Priority Data

Oct. 15, 2014 (DE) ..... 10 2014 220 839

(51) Int. Cl.
*F02M 59/00* (2006.01)
*F02M 59/10* (2006.01)
*F04B 53/16* (2006.01)

(52) U.S. Cl.
CPC ..... *F02M 59/102* (2013.01); *F04B 53/16* (2013.01); *F01L 2105/00* (2013.01); *F02M 2200/90* (2013.01)

(58) Field of Classification Search
CPC ..... F02M 59/102; F01L 2105/00
(Continued)

(56) References Cited

U.S. PATENT DOCUMENTS 1,797,781 A * 3/1931 McCaughey ..... F04B 53/143 166/179
2,179,354 A * 11/1939 Lane ..... F02M 59/00 123/446
(Continued)

FOREIGN PATENT DOCUMENTS

DE 960776 C 3/1957 ..... F04B 53/14
DE 19858862 A1 3/2000 ..... F02M 59/06
(Continued)

OTHER PUBLICATIONS

German Office Action, Application No. 102014220839.4, 4 pages, dated Oct. 1, 2015.
(Continued)

*Primary Examiner* — Hieu T Vo
*Assistant Examiner* — Sherman Manley
(74) *Attorney, Agent, or Firm* — Slayden Grubert Beard PLLC

(57) ABSTRACT

The disclosure relates to internal combustion engines in general and may be applied to a high pressure pump for a fuel injection system of an internal combustion engine. In some embodiments, the pump includes: a pump housing including a piston guide and a plunger guide bore; a piston for compressing a fuel, the piston guided in the piston guide; and a roller plunger including a plunger skirt and a roller, the roller plunger transferring a translational movement from a cam of a camshaft driven by the internal combustion engine to the piston. The plunger skirt may include an outer region
(Continued)

directed away from the roller and symmetrical about a plane of symmetry and an overall mass distributed asymmetrically about the plane of symmetry.

16 Claims, 10 Drawing Sheets

(58) Field of Classification Search
USPC ..... 92/172, 212, 210, 216
See application file for complete search history.

(56) References Cited

U.S. PATENT DOCUMENTS

| | | | | |
|---|---|---|---|---|
| 2,948,159 | A * | 8/1960 | Wirsching | F02M 59/102 277/644 |
| 4,197,787 | A * | 4/1980 | Schneider | F16J 1/10 403/150 |
| 4,204,814 | A * | 5/1980 | Matzen | F02M 59/102 417/437 |
| 4,955,284 | A * | 9/1990 | Faulkner | F02F 3/0023 92/169.2 |
| 5,957,674 | A * | 9/1999 | Zenmei | F02M 59/366 123/446 |
| 6,530,363 | B1 * | 3/2003 | Blass | F02M 39/00 123/446 |
| 6,991,438 | B2 | 1/2006 | Blessing et al. | 417/273 |
| 7,156,079 | B2 | 1/2007 | Kamiyama et al. | 123/508 |
| 7,350,505 | B2 * | 4/2008 | Felton | F02M 59/366 123/446 |
| 8,863,716 | B2 | 10/2014 | Dorn et al. | 123/90.5 |
| 9,297,376 | B2 * | 3/2016 | Sakoh | F04B 53/14 |
| 9,422,834 | B2 * | 8/2016 | Fujii | F01L 1/14 |
| 9,441,722 | B2 * | 9/2016 | Berruet | F16H 53/06 |
| 9,664,266 | B2 * | 5/2017 | Hauvespre | F16H 25/14 |
| 2004/0025684 | A1 * | 2/2004 | Djordjevic | F02M 59/06 92/129 |
| 2006/0016406 | A1 * | 1/2006 | Geyer | F01L 1/14 123/90.5 |
| 2006/0110273 | A1 * | 5/2006 | Shaull | F02M 59/102 417/470 |
| 2007/0273105 | A1 * | 11/2007 | Stanton | F04B 53/164 277/500 |
| 2010/0294219 | A1 * | 11/2010 | Prokop | F01L 1/14 123/90.5 |
| 2011/0088506 | A1 * | 4/2011 | Oishi | F01L 1/143 74/569 |
| 2011/0116945 | A1 * | 5/2011 | Shibata | F02M 59/102 417/364 |
| 2012/0152187 | A1 | 6/2012 | Cornett et al. | 123/90.5 |
| 2012/0294741 | A1 * | 11/2012 | Nishimura | F02M 59/102 417/437 |
| 2013/0206110 | A1 * | 8/2013 | Rosu | F02M 69/50 123/456 |
| 2014/0255227 | A1 * | 9/2014 | Greiner | F04B 1/0417 417/471 |
| 2015/0082938 | A1 * | 3/2015 | Schick | F01L 1/14 74/569 |
| 2015/0233332 | A1 * | 8/2015 | Hashida | F02M 59/102 417/364 |
| 2015/0247480 | A1 * | 9/2015 | Wirkowski | F02D 41/062 123/508 |
| 2015/0369097 | A1 * | 12/2015 | Hauvespre | F01M 9/106 74/559 |
| 2016/0108875 | A1 * | 4/2016 | Lamm | F02M 59/102 417/364 |
| 2017/0260947 | A1 * | 9/2017 | Graspeuntner | F02M 59/102 |

FOREIGN PATENT DOCUMENTS

| | | | | |
|---|---|---|---|---|
| DE | 102010026360 | A1 | 1/2012 | F01L 1/14 |
| EP | 1347172 | A2 | 9/2003 | F04B 1/04 |
| EP | 2628942 | A1 | 8/2013 | F02M 59/10 |
| EP | 2677124 | A1 | 12/2013 | F01L 1/14 |
| GB | 881430 | A | 11/1961 | F04B 1/02 |
| JP | 4060167 | U | 5/1992 | A47L 25/00 |
| JP | 0612703 | U | 2/1994 | F01L 1/14 |
| JP | 6200714 | A | 7/1994 | F01L 1/14 |
| JP | 11050818 | A | 2/1999 | F01L 1/14 |
| JP | 2001221131 | A | 8/2001 | F02M 59/10 |
| JP | 2004270641 | A | 9/2004 | F02M 39/02 |
| JP | 2008045441 | A | 2/2008 | F02M 59/10 |
| JP | 2010112193 | A | 5/2010 | F02M 59/10 |
| JP | 2011231652 | A | 11/2011 | F02M 59/10 |
| KR | 20120029667 | A | 3/2012 | F02M 59/10 |
| WO | 2016/058877 | A1 | 4/1916 | F02M 59/06 |
| WO | 2016/058878 | A1 | 4/1916 | F01L 1/14 |
| WO | 2008/012295 | A2 | 1/2008 | F02M 59/06 |
| WO | 2012/082768 | A1 | 6/2012 | F01L 1/14 |
| WO | 2013/119214 | A1 | 8/2013 | F01L 1/14 |

OTHER PUBLICATIONS

German Office Action, Application No. 102014220937.4, 11 pages, Oct. 8, 2015.
International Search Report and Written Opinion, Application No. PCT/EP2015/073114, 14 pages, dated Dec. 17, 2015.
International Search Report and Written Opinion, Application No. PCT/EP2015/073113, 14 pages, dated Jan. 4, 2016.
Korean Office Action, Application No. 20167025925, 16 pages, dated Jan. 5, 2018.
Japanese Office Action, Application No. 2016557651, 5 pages, dated Sep. 25, 2017.
Japanese Office Action, Application No. 2016555610, 5 pages, dated Sep. 19, 2017.
Japanese Office Action, Application No. 2016557651, 2 pages, dated May 14, 2018.
Korean Notice of Allowance, Application No. 2018038655721, 3 pages, dated Jun. 7, 2018.
Chinese Office Action, Application No. 201580017959.9, 17 pages, dated May 30, 2018.

* cited by examiner

HIGH PRESSURE PUMP FOR A FUEL INJECTION SYSTEM OF AN INTERNAL COMBUSTION ENGINE

CROSS-REFERENCE TO RELATED APPLICATIONS

This application is a U.S. National Stage Application of International Application No. PCT/EP2015/073114 filed Oct. 7, 2015, which designates the United States of America, and claims priority to DE Application No. 10 2014 220 839.4 filed Oct. 15, 2014, the contents of which are hereby incorporated by reference in their entirety.

TECHNICAL FIELD

The disclosure relates to internal combustion engines in general and may be applied to a high pressure pump for a fuel injection system of an internal combustion engine.

BACKGROUND

High pressure pumps in fuel injection systems are used to load a fuel with a high pressure, the pressure, for example in the case of gasoline internal combustion engines, lying in the range from 250-400 bar and, in the case of diesel internal combustion engines, lying in the range from 2000 bar-2500 bar. The higher the pressure generated in the respective fuel, the lower the emissions which are produced during the combustion of the fuel in a combustion chamber.

To achieve the high pressures in the respective fuel, the high pressure pump is typically configured as a piston pump with the piston driven by a roller plunger. The roller plunger has a roller in contact with a cam surface of a cam of a camshaft driven by the internal combustion engine. Here, a rotational movement of the camshaft is converted via the roller plunger into a translational movement and is transferred to a piston of the high pressure pump.

During the conversion of the rotational movement of the camshaft into a translational movement, both axial forces and lateral forces are transmitted to the roller plunger by way of the cam surface. The lateral forces can lead to tilting of the roller plunger within a plunger guide in the high pressure pump.

Attempts to manage said tilting seek to maintain a ratio of a roller plunger length L to a roller plunger external diameter D within the range of L/D>1. Furthermore, if a roller plunger axis is arranged offset toward the axis of the camshaft, a contact angle between the roller plunger and the cam surface can be decreased, in order to reduce the resulting lateral forces. Here, the geometry and also the center of mass of the roller plunger are chosen in a way that, as far as possible, no offset with respect to the roller plunger axis is produced, which roller plunger axis is arranged offset toward the axis of the camshaft.

In addition, there are also arrangements which provide an anti-rotation safeguard in order to avoid rotations of the roller plunger in the roller plunger guide.

SUMMARY

The abovementioned measures are not sufficient to counteract uncontrolled tilting of the roller plunger in its roller plunger guide, and/or are complicated to manufacture, such as the provision of an anti-rotation safeguard. The teachings of the present disclosure provide an alternative arrangement which makes control of the tilting of the roller plunger in its roller plunger guide possible.

In some embodiments, a high pressure pump (10) for a fuel injection system (12) of an internal combustion engine (14) includes a pump housing (20) for receiving elements of the high pressure pump (10), a piston (22) for loading a fuel (25) with pressure, the piston (22) being guided in a piston guide (18) of the pump housing (20), a roller plunger (30) with a plunger skirt (36) and a roller (34) for transferring a translational movement from a cam (28) of a camshaft (26) to the piston (22), the roller plunger (30) being guided in a plunger guide bore (44) in the pump housing (20), the plunger skirt (36) having an outer region (46) which is directed away from the roller (34) and is configured so as to be symmetrical about a plane of symmetry (48), the plunger skirt (36) having an overall mass (64) which is arranged in a manner which is distributed asymmetrically about the plane of symmetry (48).

In some embodiments, the plunger skirt (36) has a crossmember (40) for making contact with the piston (22) and a circumferential wall (42) for receiving the roller (34), the overall mass (64) being arranged on the crossmember (40) and/or the circumferential wall (42) in a manner which is distributed asymmetrically about the plane of symmetry (48).

In some embodiments, the overall mass (64) of the plunger skirt (36) is formed by the sum of a basic mass (74) of a plunger skirt (36) which is configured symmetrically with respect to the plane of symmetry (48) and an unbalance mass (70) which is attached asymmetrically with respect to the plane of symmetry (48) on an inner region (72) of the plunger skirt (36), which inner region (72) is directed toward the roller (34), the unbalance mass (70) being arranged, in particular, in a contact region (60) of the crossmember (40) and the circumferential wall (42).

In some embodiments, the unbalance mass (70) is arranged in the plunger skirt (36) without contact with the roller (34), the circumferential wall (42) having a length (84) parallel to the plunger guide bore (44), starting from a contact region (60) with the crossmember (40) as far as an open end (58) which lies opposite the contact region (60), the unbalance mass (70) extending, starting from the contact region (60), for example over half the length of the circumferential wall (42), over a third of the length (84), or a quarter of the length (84).

In some embodiments, the unbalance mass (70) is of triangular configuration in the longitudinal section parallel to the plunger guide bore (44), a first triangle leg (76) being formed by way of a part region of the crossmember (78) and a second triangle leg (80) being formed by way of a part region of the circumferential wall (82), or in that at least one projection is arranged on the crossmember (40) and/or the circumferential wall (42) in the contact region (60).

In some embodiments, the unbalance mass (70) is from 10% to 100% of the basic mass (74), or from 20% to 50% of the basic mass (74).

In some embodiments, the circumferential wall (42) has at least one notch (90) which is arranged asymmetrically with respect to the plane of symmetry (48).

In some embodiments, the circumferential wall (42) has a length (84) parallel to the plunger guide bore (44), starting from a contact region (60) with the crossmember (40) as far as an open end (58) which lies opposite the contact region (60), the notch extending, starting from the open end (58), over half the length (84) of the circumferential wall (42), over a third of the length (84), or over a quarter of the length (84).

In some embodiments, the circumferential wall (42) is configured with a cavity (92), the circumferential wall (42) having a length (84) preferably parallel to the plunger guide bore (44), starting from a contact region (60) with the crossmember (40) as far as an open end (58) which lies opposite the contact region (60), the cavity (92) preferably being arranged in a third of the circumferential wall (42) which is adjacent to the open end (58).

In some embodiments, the roller plunger (30) is manufactured from at least two different materials (94, 96) of different density which are arranged on the crossmember (40) and/or the circumferential wall (42) in a manner which is distributed asymmetrically about the plane of symmetry (48).

BRIEF DESCRIPTION OF THE DRAWINGS

The teachings of the present disclosure will be explained in greater detail in the following text using the appended drawings, in which.

DETAILED DESCRIPTION

Figure 1:
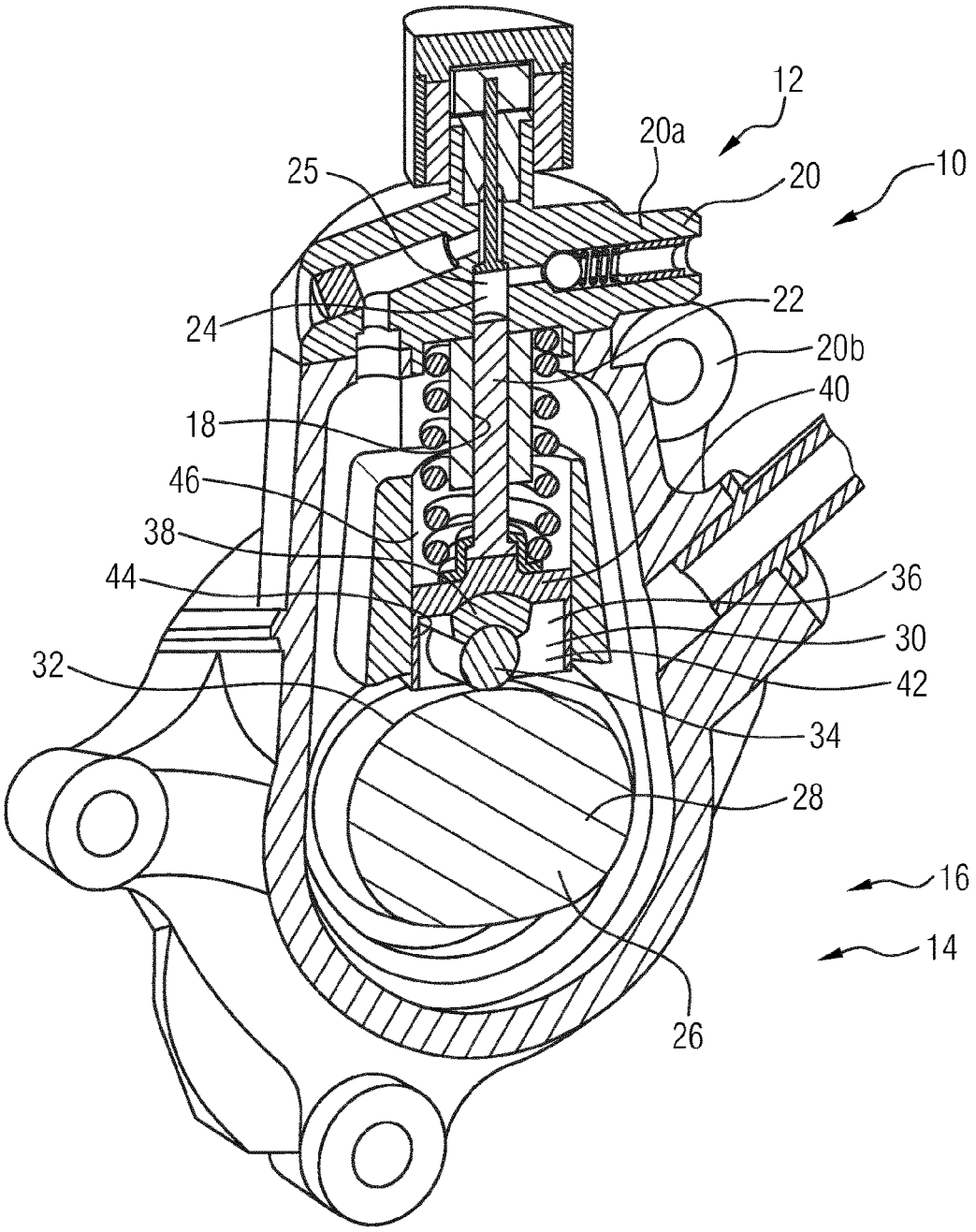
FIG. 1 shows a perspective illustration of a longitudinal section of an example high pressure pump having a roller plunger, a roller of the roller plunger running in a roller shoe.

A high pressure pump for a fuel injection system of an internal combustion engine may include a pump housing for receiving elements of the high pressure pump. Here, the pump housing is assembled from a cylinder region and a lower housing region. Furthermore, the high pressure pump has a piston for loading a fuel with pressure, which piston is guided in a piston guide of the pump housing, in particular in the cylinder region, and has a roller plunger with a plunger skirt and a roller for transmitting a translational movement from a cam of a camshaft to the piston, the roller plunger being guided in a plunger guide bore on the pump housing, in particular in the lower housing region. The plunger skirt has an outer region which is directed away from the roller and is configured so as to be symmetrical about a plane of symmetry, the plunger skirt having an overall mass which is arranged in a manner which is distributed asymmetrically about the plane of symmetry.

In order to lubricate the roller plunger, a play of from approximately 0.06 mm to 0.1 mm may be provided in the roller plunger guide bore.

In contrast to known arrangements, a center of mass of the roller plunger does not lie as far as possible on a plane of symmetry of the roller plunger which lies perpendicularly on a camshaft axis, but rather the mass is configured in a targeted manner so as to be distributed asymmetrically about the plane of symmetry. As a result, a torque $M_{Masse}$ can be caused which counteracts the tilting moment. By way of targeted provision of the mass with a predefined asymmetry, the tilting of the roller plunger in its plunger guide bore can be influenced in a targeted manner in the region of the play. Firstly, the tilting moment can be reduced; lateral forces which act on the plunger guide bore can therefore be transmitted in a more homogeneous manner. Secondly, the time of tilting can be influenced in a predictable manner.

In order to further keep the tilting of the roller plunger in the plunger guide bore low, a ratio of a roller plunger length L to a roller plunger external diameter D may be $L/D>1$. Furthermore, a roller plunger axis, furthermore, may lie perpendicularly on the axis of the camshaft.

Although an anti-rotation safeguard can in principle be dispensed with, rotation can also occur in addition to the tilting of the roller plunger in the plunger guide bore as a result of the action of lateral forces, in particular if the roller plunger is of rotationally symmetrical configuration. If an anti-rotation safeguard is additionally provided, for example formed by way of a projection which is arranged either on the plunger guide bore or on the outer region of the plunger skirt, and which is in engagement with a notch on the plunger skirt or plunger guide bore rotation may be further limited.

The plunger skirt may be of rotationally symmetrical configuration, that is to say of circular configuration in cross section perpendicularly with respect to a longitudinal extent of the plunger skirt. Here, the plane of symmetry runs on a circle radius through a circle center point of the plunger skirt of circular configuration.

As an alternative, it is also possible that the plunger skirt is of rectangular or square configuration in cross section perpendicularly with respect to its longitudinal extent. In this case, the plane of symmetry runs on a median of the sides of the rectangle or the square. In this case, there are correspondingly two planes of symmetry through the plunger skirt.

The plunger skirt preferably has a crossmember for making contact with the piston and a circumferential wall for receiving the roller, the overall mass of the plunger skirt being arranged on the crossmember and/or the circumferential wall in a manner which is distributed asymmetrically about the plane of symmetry.

The overall mass includes the combination of the mass of the crossmember and of the circumferential wall. In the case of the asymmetrical distribution of the overall mass about the plane of symmetry of the plunger skirt, both the crossmember and the circumferential wall may have an asymmetrical mass distribution. As a result, a plurality of degrees of freedom are available during the manufacture of the plunger skirt, which degrees of freedom make an uneven mass distribution of the plunger skirt possible.

The overall mass of the plunger skirt may include the sum of a basic mass of a plunger skirt which is configured symmetrically with respect to the plane of symmetry and an unbalance mass which is attached asymmetrically with respect to the plane of symmetry on an inner region of the plunger skirt, which inner region is directed toward the roller.

The plunger skirt can be manufactured simply by adding an additional mass in the form of the unbalance mass arranged on a plunger skirt produced as usual and symmetrical with regard to its geometry and its center of mass, and/or eccentrically, that is to say asymmetrically with respect to the plane of symmetry of the plunger skirt, providing a mass imbalance of the plunger skirt. Here, the unbalance mass may be arranged in a contact region of the crossmember and the circumferential wall, since the greatest space for attaching an unbalance mass is advantageously available here on account of the geometry of the plunger skirt.

In some embodiments, the unbalance mass is arranged in the plunger skirt without contact with the roller to prevent the unbalance mass from impeding the mobility of the roller. The circumferential wall of the plunger skirt has a length parallel to the plunger guide bore, starting from a contact region with the crossmember as far as an open end which lies opposite the contact region. In some embodiments, the unbalance mass extends, starting from the contact region, over half the length of the circumferential wall. In some embodiments, the unbalance mass extends over a third of the length or over a quarter of the length. As a result, disruptive contact with the roller can be reduced and/or avoided.

In the case of a roller plunger without an asymmetrically distributed overall mass, considerably greater forces act on the plunger guide bore in the region of the open end of the plunger skirt than in a region of the roller plunger close to the piston, that is to say in a contact region of the crossmember and the circumferential wall. In order to counteract this, the unbalance mass may be arranged closer to the contact region than to the open end. As a result, an improved distribution of forces is achieved, which counteracts the tilting of the roller plunger in the plunger guide bore.

The unbalance mass may have a triangular configuration in the longitudinal section parallel to the plunger guide bore. A first triangle leg may be formed by way of a part region of the crossmember and a second triangle leg formed by way of a part region of the circumferential wall. A triangular configuration of the unbalance mass, the triangle sharing side regions with already present elements of the plunger skirt such as the crossmember and the circumferential wall, may be manufactured more easily. In cases, in which a triangular configuration of the unbalance mass can be unfavorable, however, because a torque $M_{Masse}$ which is too strong would be produced, for example, as a result, merely one projection may be provided either on the crossmember or on the circumferential wall or on the crossmember and the circumferential wall. For example, journals can be arranged to this end on the crossmember and/or on the circumferential wall.

The unbalance mass may include from 10% to 100% of the basic mass, and, in some embodiments, from 20% to 50% of the basic mass. If, for example, the basic mass of the plunger skirt is approximately 100 g, the unbalance mass may have a mass between approximately 20 g to 50 g.

Therefore, the unbalance mass can have the same mass as the basic mass of a plunger skirt which is configured symmetrically with respect to the plane of symmetry, and the balance of forces which act at the open end to forces which act at the contact region can be shifted greatly here. In some embodiments, however, the unbalance mass lies in a range of from 20% to 50% of the basic mass, since the torque $M_{Masse}$ thus counteracts the original torque of the roller plunger in the plunger guide bore.

The unbalance mass may be arranged in the plunger skirt in such a way that a centroid of the unbalance mass is spaced apart by approximately 10 mm from the plane of symmetry of the plunger skirt.

In addition or as an alternative to the unbalance mass, the circumferential wall can also have at least one notch which is arranged asymmetrically with respect to the plane of symmetry. This is a further possibility to arrange the overall mass of the plunger skirt asymmetrically about the plane of symmetry, which possibility can be manufactured particularly simply.

In some embodiments, the notch extends, starting from the open end of the circumferential wall, over half the length of the circumferential wall, over a third of the length, or over a quarter of the length. This has the same effects as in the case of the arrangement of the unbalance mass in the contact region of the crossmember and the circumferential wall, which contact region lies opposite the open end.

As an alternative or in addition to the unbalance mass and/or the notch, the circumferential wall can also be configured with a cavity, the cavity arranged in a third of the circumferential wall which is adjacent to the open end.

In addition or as an alternative, it is also possible to manufacture the roller plunger and, in particular, the plunger skirt from at least two different materials which have a different density. Said materials can then preferably be arranged on the crossmember and/or the circumferential wall in a manner which is distributed asymmetrically.

Figure 2:
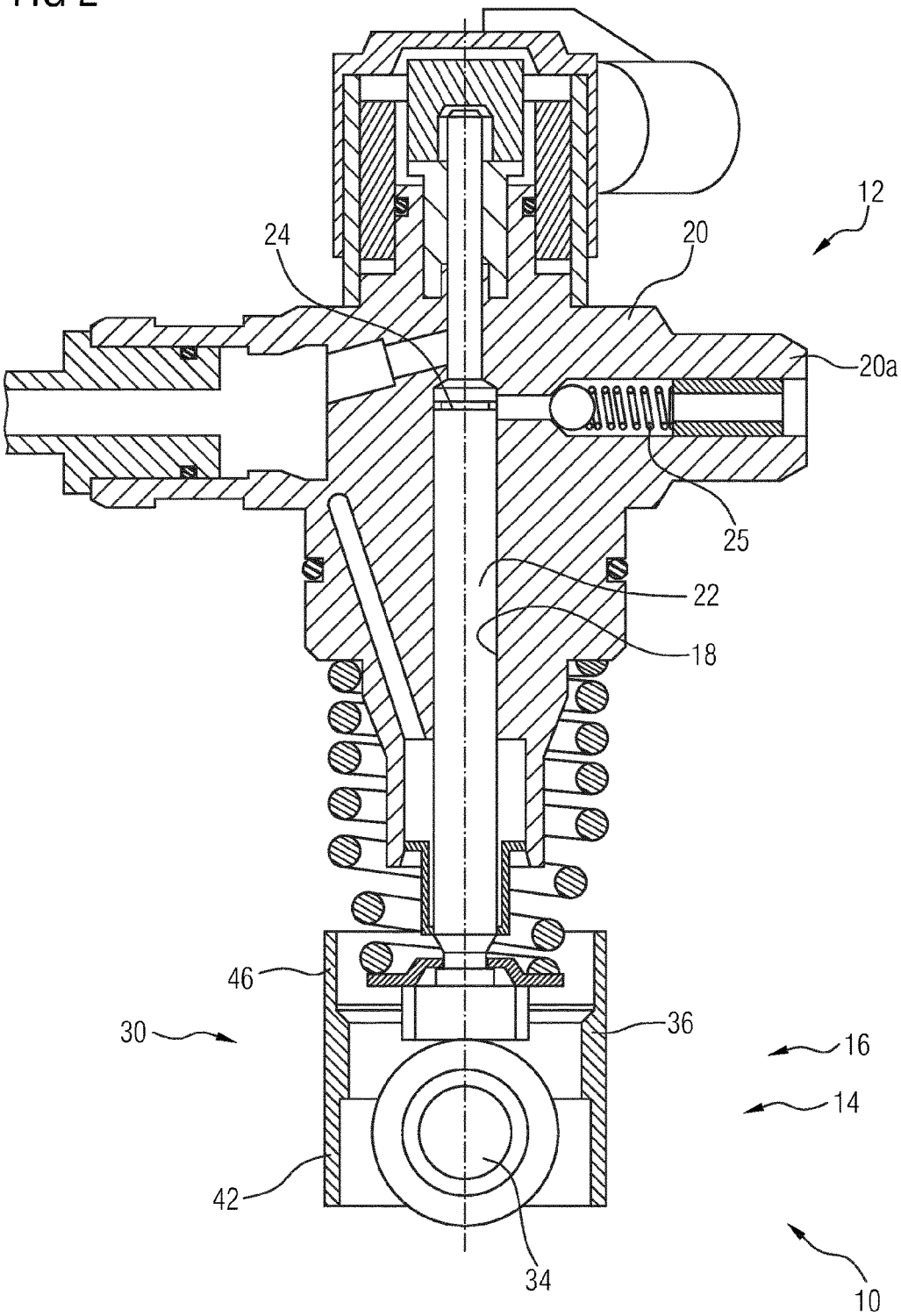
FIG. 2 shows a longitudinal sectional illustration of an example high pressure pump having a roller plunger without a roller shoe.

FIG. 1 and FIG. 2 in each case show a longitudinal sectional illustration of an example high pressure pump 10 in a fuel injection system of an internal combustion engine 14.

The high pressure pump 10 includes a piston pump 16 and has a piston 22 which is guided in a piston guide 18 of a pump housing 20, performs a translational movement during operation, and in the process compresses a fuel 25 which is situated in a pressure space 24 and therefore loads it with pressure. In the present embodiment, the pump housing 20 is constructed from two part regions, namely a cylinder region 20*a* and a lower housing region 20*b*. Here, the piston guide 18 is arranged in the cylinder region 20*a*.

The translational movement of the piston 22 is driven by a camshaft 26 having two cams 28, which camshaft 26 for its part is driven by the internal combustion engine 14. In order to convert a rotational movement of the camshaft 26 into the translational movement of the piston 22, a roller plunger 30 has a roller 34 which makes contact with a surface 32 of the camshaft 26 and a plunger skirt 36 which is in contact with the piston 22.

In the embodiment which is shown in FIG. 1, the roller 34 rolls in an additional roller shoe 38 which is arranged in the plunger skirt 36, whereas no additional roller shoe 38 is provided in the high pressure pump 10 which is shown in FIG. 2.

The plunger skirt 36 has a crossmember 40 which makes contact with the piston 22, and a circumferential wall 42, in which the roller 34 is received and which serves to guide the entire roller plunger 30 in a plunger guide bore 44 of the pump housing 20 in the lower housing region 20*b* which is not shown in FIG. 2.

The plunger skirt 36 is arranged on an outer region 46 symmetrically about a plane of symmetry 48. This is shown diagrammatically for two different embodiments of the plunger skirt 36 in FIG. 3 and FIG. 4.

Figure 3:
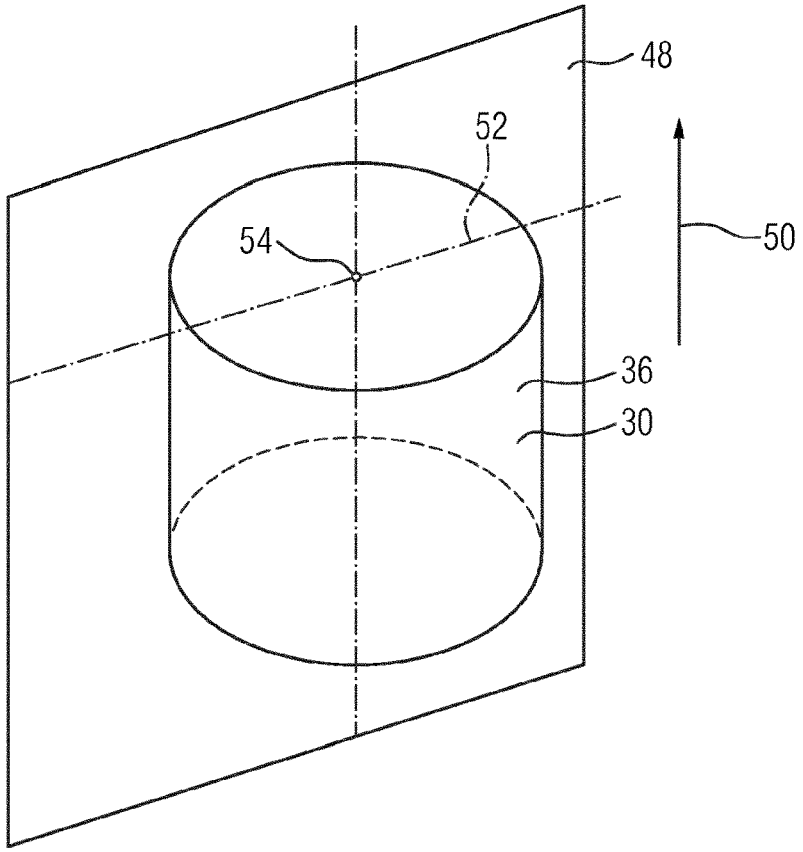
FIG. 3 shows a perspective illustration of a roller skirt of the roller plunger from FIG. 1 and FIG. 2, which roller plunger is of circular configuration in cross section perpendicularly with respect to a longitudinal extent.

Here, FIG. 3 shows a plunger skirt 36 which is of circular configuration in cross section perpendicularly with respect to its longitudinal extent 50. Here, the plane of symmetry 48 runs on a circle radius 52 through a circle center point 54.

Figure 4:
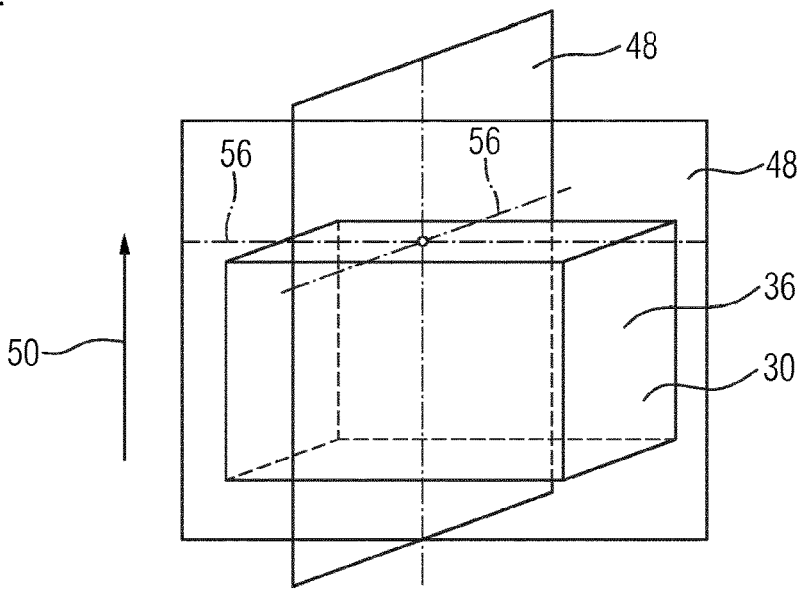
FIG. 4 shows a perspective illustration of an example plunger skirt which is of rectangular configuration in cross section perpendicularly with respect to a longitudinal extent.

In some embodiments, the plunger skirt 36 can also be of rectangular configuration in cross section perpendicularly with respect to its longitudinal extent 50, as shown in FIG. 4. In this case, the plunger skirt 36 has two planes of symmetry 48 which in each case run on a median 56.

Figure 5:
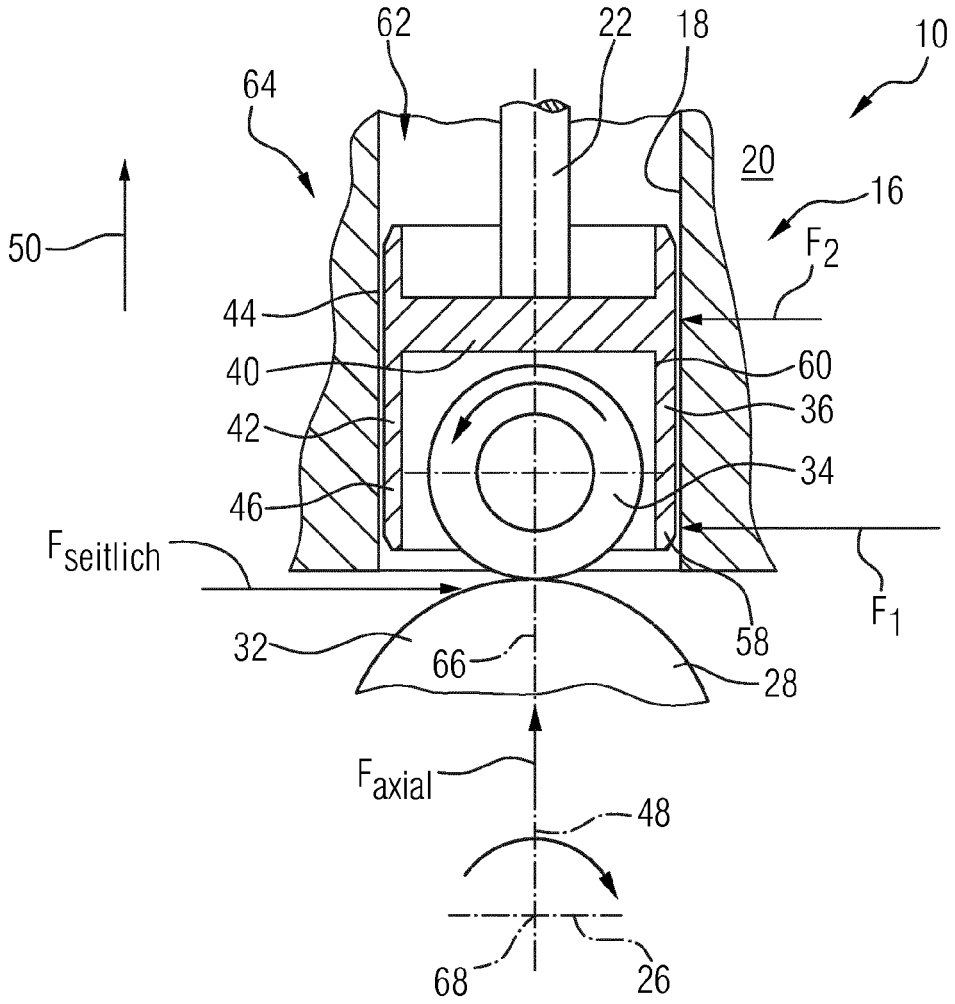
FIG. 5 shows a diagrammatic longitudinal sectional illustration of an example roller plunger which is configured symmetrically about a plane of symmetry, with forces which act during operation of the roller plunger.

FIG. 5 diagrammatically shows an arrangement comprising cam 28, roller plunger 30 and piston 22, the plunger skirt 36 being of symmetrical configuration about the plane of symmetry 48 both in terms of geometry and in terms of overall mass.

During a stroke of the piston 22, that is to say when pumping the fuel 25 and when sucking in the fuel 25, forces both in the axial direction $F_{axial}$ and in the lateral direction $F_{seitlich}$ are introduced into the roller plunger 30 by way of the surface 32, in order finally to transmit the force via the piston 22 to the fuel 25 in the form of pressure. The lateral forces $F_{seitlich}$ are absorbed by the plunger guide bore 44 and are denoted by $F_1$ and $F_2$ in FIG. 5.

Here, $F_1$ denotes a lateral force which acts in the region of an open end 58 of the circumferential wall 42 of the plunger skirt 36. Here, $F_2$ denotes a lateral force which acts in a contact region 60 of the crossmember 40 with the circumferential wall 42. As can be seen in FIG. 5, the forces $F_1$ and $F_2$ are distributed in an inhomogeneous manner, with the result that the roller plunger 30 may tilt within the plunger guide bore 44.

As is further apparent from FIG. 5, a geometry 62 and an overall mass 64 of the plunger skirt 36 are arranged symmetrically about the plane of symmetry 48. In addition, a roller plunger axis 66 is arranged in such a way that it runs perpendicularly through an axis 68 of the camshaft 26, in order thus to decrease the contact angle between the cam 28 and the roller 34 and therefore to reduce resulting lateral forces. Despite a reduction in the lateral forces $F_{seitlich}$, however, tilting of the roller plunger 30 in the plunger guide bore 44 may not be prevented.

In some embodiments, the overall mass 64 of the plunger skirt 36 is distributed eccentrically, that is to say distributed asymmetrically about the plane of symmetry 48. By way of asymmetrical distribution of the overall mass 64 about the plane of symmetry 48, the contact angle between the cam 28 and the roller 34 is not changed, but a possibility is provided without changing a stroke profile or a cam profile of influencing the lateral forces $F_{seitlich}$ on the roller plunger 30. This is because the lateral forces $F_1$ and $F_2$ can be distributed more homogeneously by way of asymmetrical arrangement of the overall mass 64, and said lateral forces $F_1$ and $F_2$ are therefore transmitted more homogeneously to the plunger guide bore 44.

Figure 6:
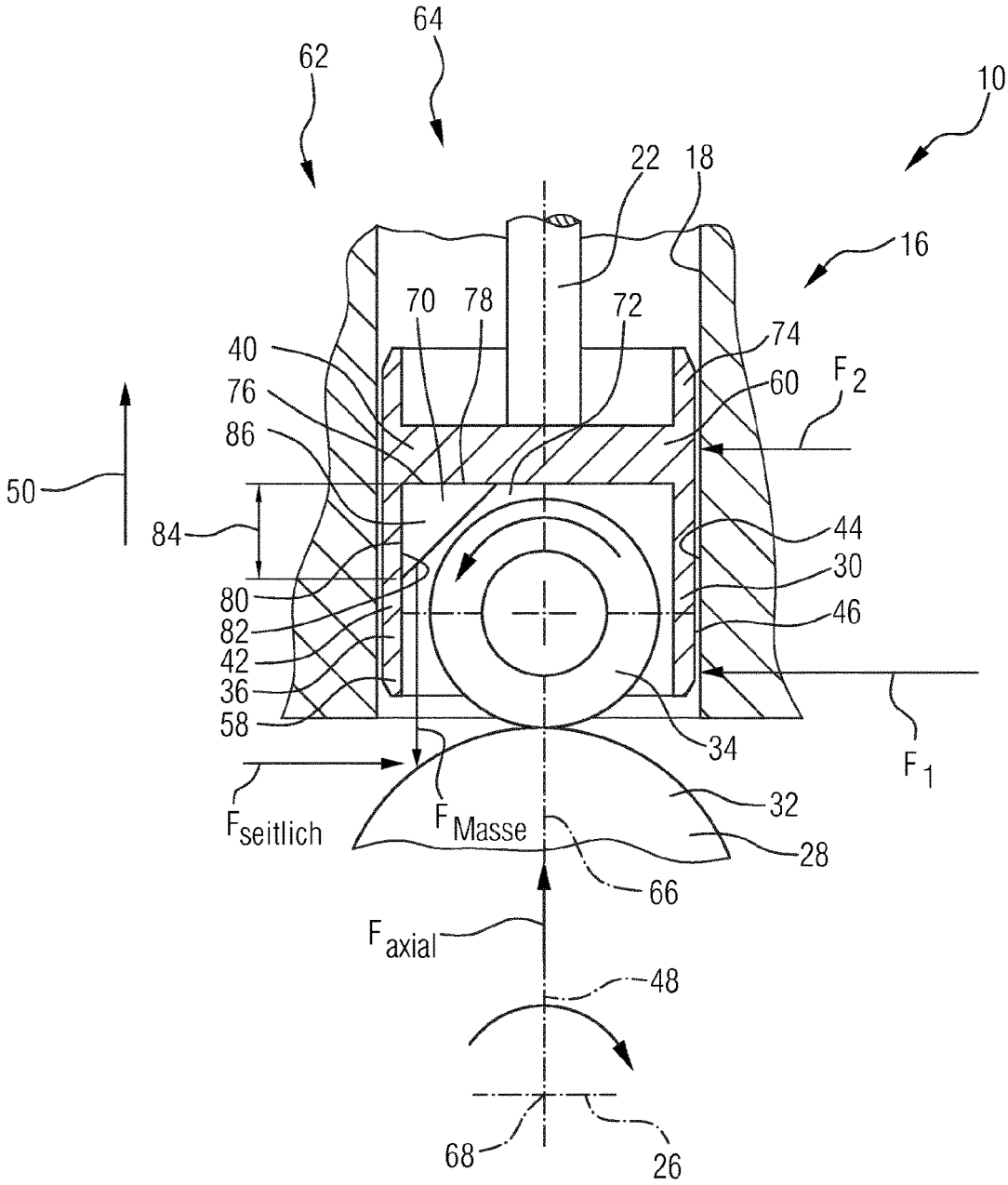
FIG. 6 shows a diagrammatic longitudinal sectional illustration of a first embodiment of a roller plunger which is configured asymmetrically about the plane of symmetry, with a triangular unbalance mass.

To this end, as shown diagrammatically in FIG. 6, some embodiments may include an unbalance mass 70, for example, arranged asymmetrically with respect to the plane of symmetry 48 in an inner region 72 of the plunger skirt 36 and, together with a basic mass 74 of a plunger skirt 36 of symmetrical formation with regard to the plane of symmetry 48, forms the overall mass 64 of the plunger skirt 36.

The unbalance mass 70 entails an acceleration force $F_{Masse}$ which results in a torque $M_{Masse}$ which counteracts the tilting moment of the roller plunger 30, which tilting moment results from the inhomogeneous distribution of the forces $F_1$ and $F_2$.

As a result, the tilting moment can be influenced and reduced, and edge loads on the roller plunger 30 can be reduced by way of inhomogeneous distribution of $F_1$ and $F_2$. In addition, the time of tilting, that is to say the sudden and one-sided release of the roller plunger 30 from the plunger guide bore 44, can be changed in such a way that the tilting does not have any negative influence on the kinematics.

For example, a large acceleration at the roller 34 might lead to slip between the surface 32 of the camshaft 26 and the roller 34, it being possible for the tilting of the roller plunger 30 to change this acceleration profile. Therefore, the slip can also be improved by way of changing the tilting behavior of the roller plunger 30.

FIG. 6 shows a first embodiment of a diagrammatic longitudinal sectional illustration of the roller plunger 30 which shows how the overall mass 64 can be arranged in a manner which is distributed asymmetrically about the plane of symmetry 48, namely by way of the provision of an unbalance mass 70 in the contact region 60 of the crossmember 40 and the circumferential wall 42. An unbalance mass 70 of this type on the plunger skirt 36 can be produced very simply; it is merely advantageously to be ensured that the unbalance mass is arranged in the plunger skirt 36 without contact with the roller 34. As a result, the unbalance mass 70 can be, for example, of triangular configuration in longitudinal section with respect to the parallel to the plunger guide bore 44, as shown in FIG. 6. A first triangle leg 76 is particularly advantageously formed by way of a part region 78 of the crossmember 40, and a second triangle leg 80 is formed by way of a part region 82 of the circumferential wall 42.

In some embodiments, the unbalance mass 70 is situated in an upper region of the plunger skirt 36, that is to say in a circumferential wall 42 which has a defined length 84, starting from the contact region 60 toward the open end 58, extends, starting from the contact region 60, over half the length 84 or over a third of the length 84 or over a quarter of the length 84. As a result, a centroid 86 of the unbalance mass 70 is influenced, which for its part, via the equation $M_{Masse}$=D (centroid 86 to roller plunger axis 66)×$F_{Masse}$, influences the torque $M_{Masse}$ which counteracts the tilting moment of the roller plunger 30 in the plunger guide bore 44.

Via $F_{Masse}$, the torque $M_{Masse}$ is also influenced by the actual mass of the unbalance mass 70. In some embodiments, the unbalance mass 70 is from 10% to 100% of the basic mass 74. In some embodiments, the unbalance mass lies in a range of from 20% to 50% of the basic mass 74.

Figure 7:
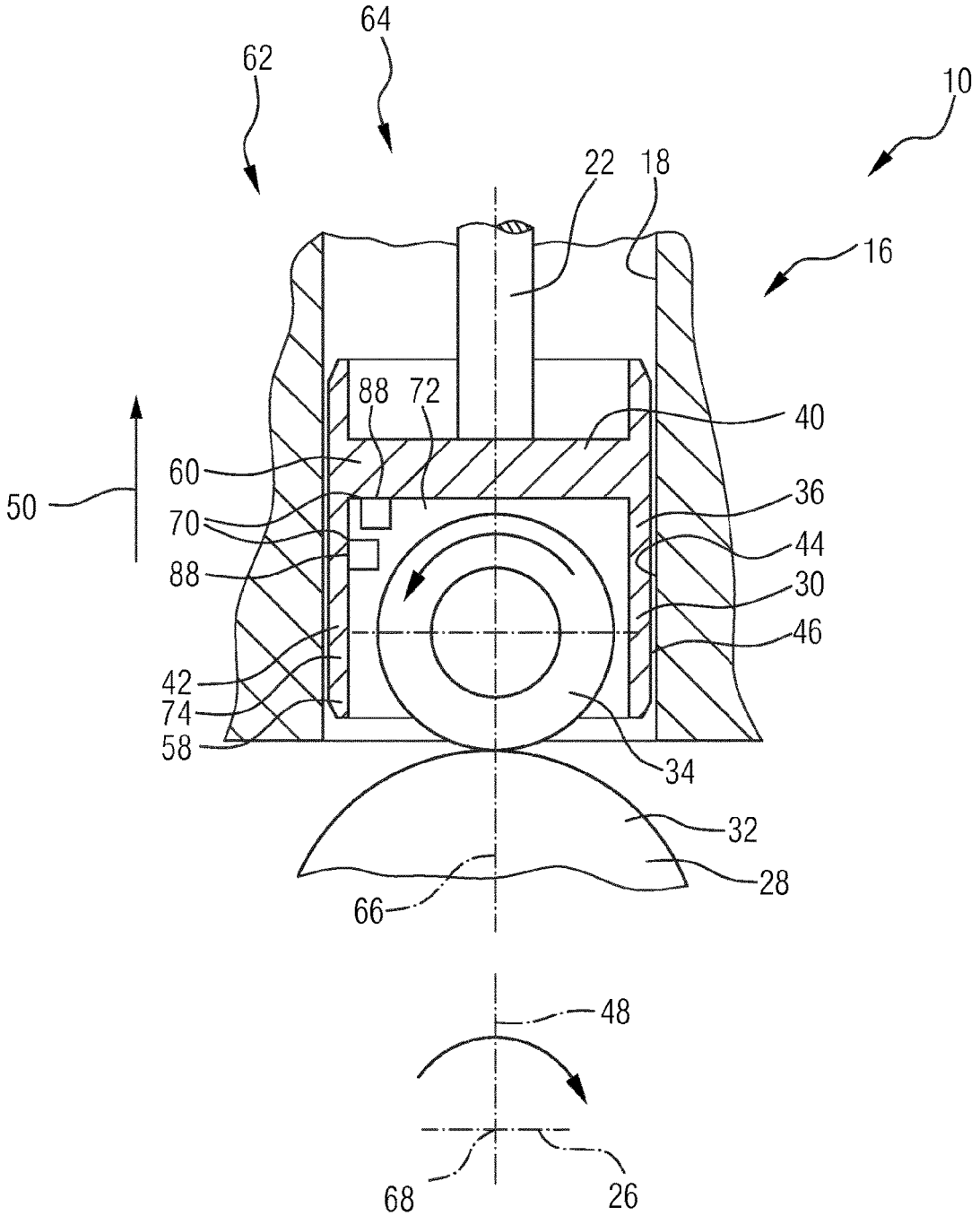
FIG. 7 shows a diagrammatic longitudinal sectional illustration of a second embodiment of a roller plunger with projections, which roller plunger is configured asymmetrically about the plane of symmetry.

In some embodiments, without the triangular form of the unbalance mass 70 which is shown in FIG. 6, projections 88 can be provided on the crossmember 40 and/or the circumferential wall 42, as shown in the longitudinal sectional illustration in FIG. 7, which projections 88 likewise, just like the triangular unbalance mass 70, may extend, starting from the contact region 60, over half the length 84, or a third of the length 84, or a quarter of the length 84 of the circumferential wall 42.

Figure 8:
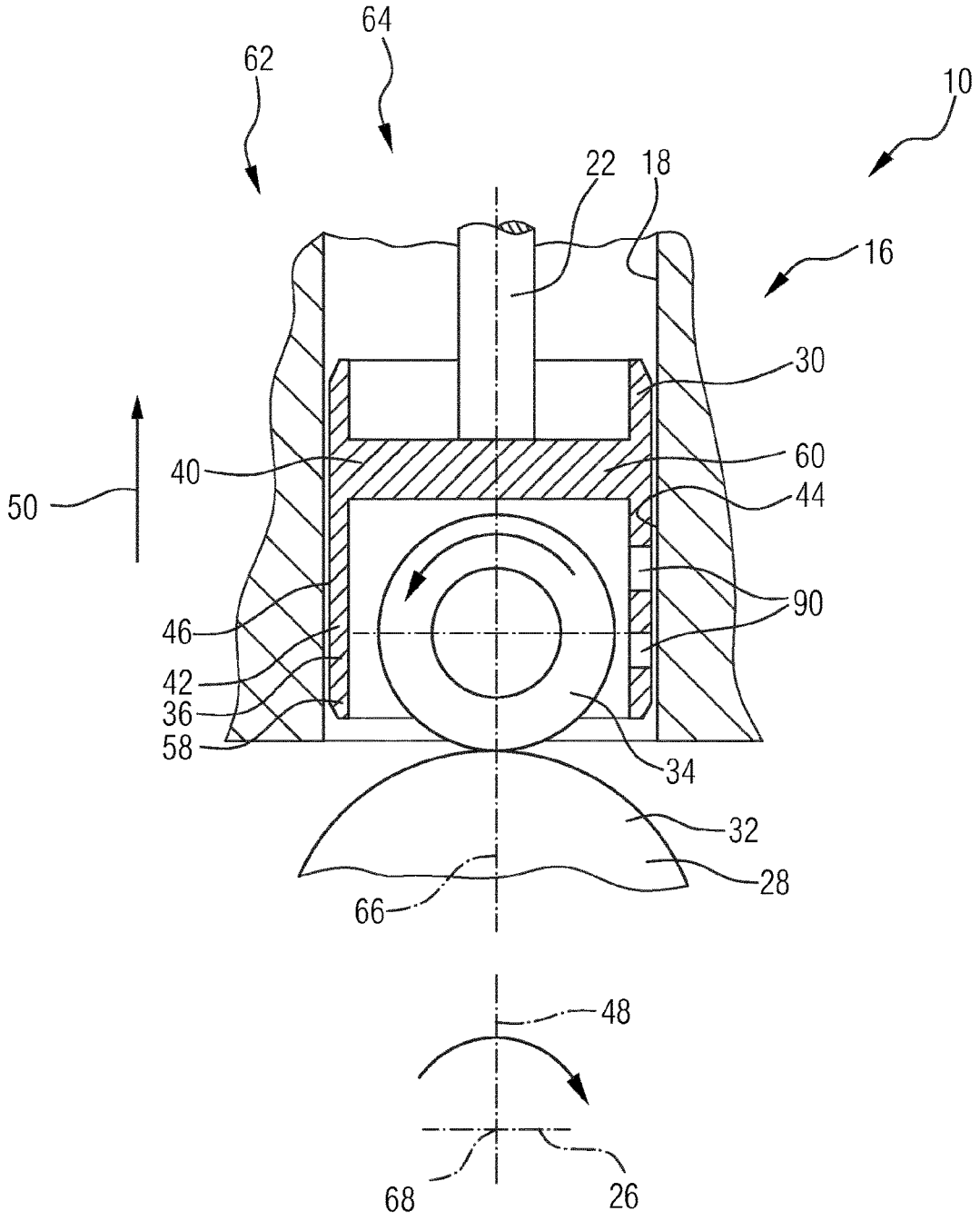
FIG. 8 shows a diagrammatic longitudinal sectional illustration of a third embodiment of a roller plunger which is configured asymmetrically about the plane of symmetry, with a notch in a circumferential wall of the plunger skirt.
Figure 9:
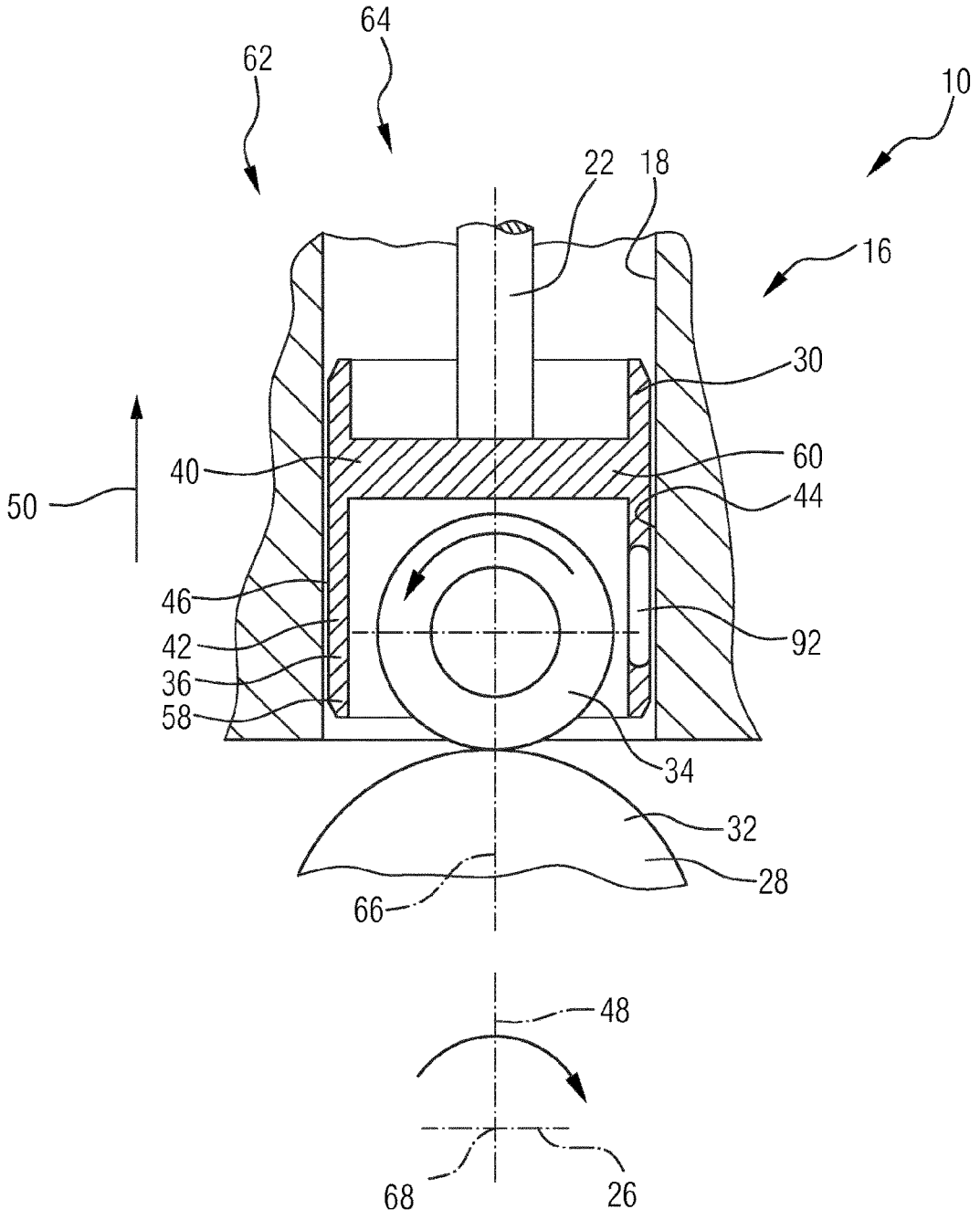
FIG. 9 shows a diagrammatic longitudinal sectional illustration of a fourth embodiment of a roller plunger which is configured asymmetrically about the plane of symmetry, with a cavity in the circumferential wall of the plunger skirt.

FIG. 8 and FIG. 9 show diagrammatic longitudinal sectional illustrations of alternative embodiments of the plunger skirt, in which an additional unbalance mass 70 is not provided in the inner region 72 of the circumferential wall 42, but rather in which a region of the circumferential wall 42 has one or more notches 90 or a cavity 92. As a result, the mass of the circumferential wall 42 in the region which has the notch 90 or the cavity 92 becomes lower than in other regions of the circumferential wall 42, and this results overall in an overall mass 64 of the plunger skirt 36 which is distributed asymmetrically with respect to the plane of symmetry 48.

Figure 10:
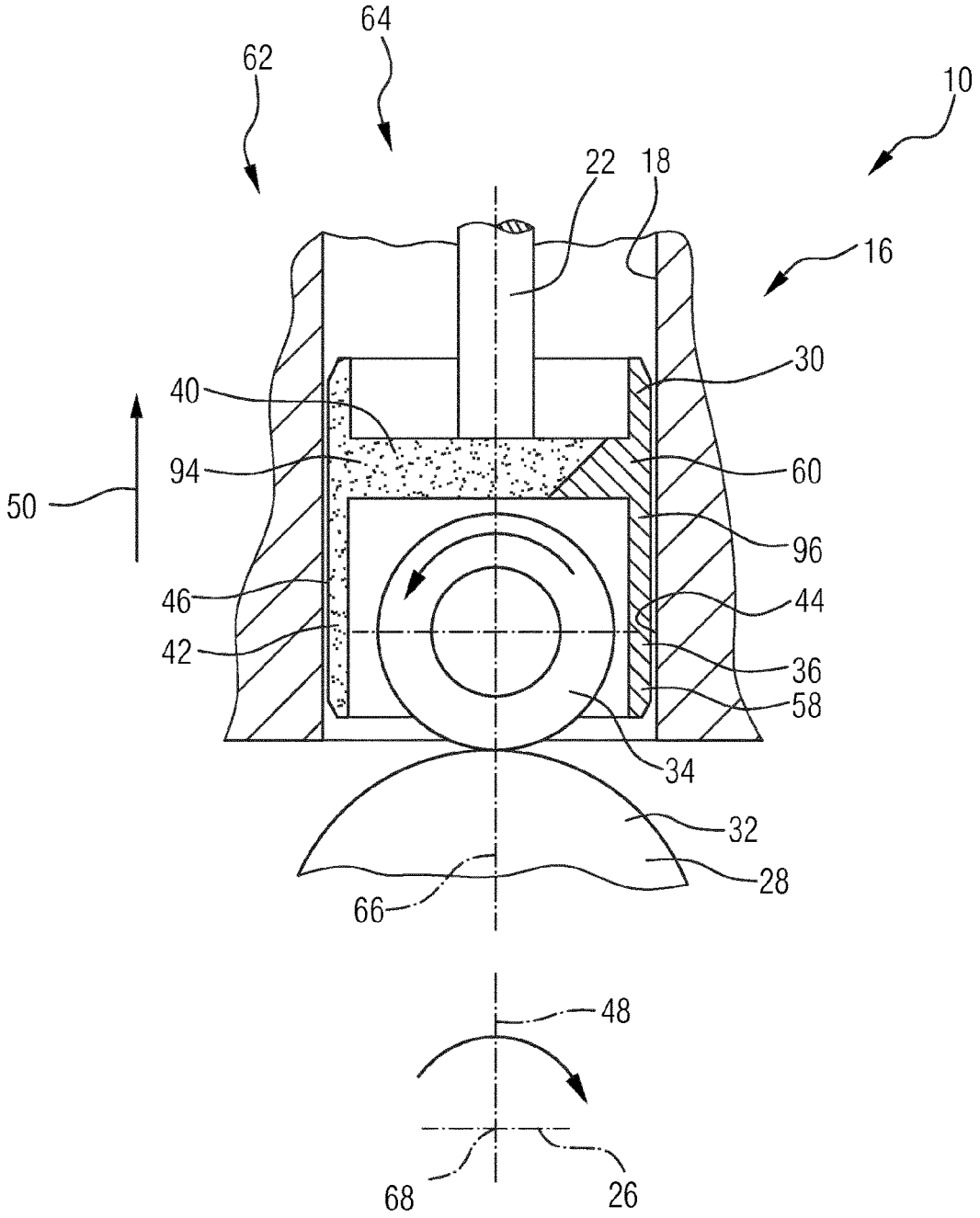
FIG. 10 shows a diagrammatic longitudinal sectional illustration of a roller plunger which is formed from two different materials, the materials having different densities and being arranged asymmetrically about the plane of symmetry of the roller plunger.

A further alternative which is shown in FIG. 10 in longitudinal section is the provision of different materials, a first material 94 having a first density and a second material 96 having a second density which is different than the first density. The plunger skirt 36 is manufactured from the two materials 94, 96, the materials 94, 96 being arranged asymmetrically around the plane of symmetry 48, which results overall in an overall mass 64 of the plunger skirt 36 which is distributed asymmetrically with respect to the plane of symmetry 48.

Figure 11:
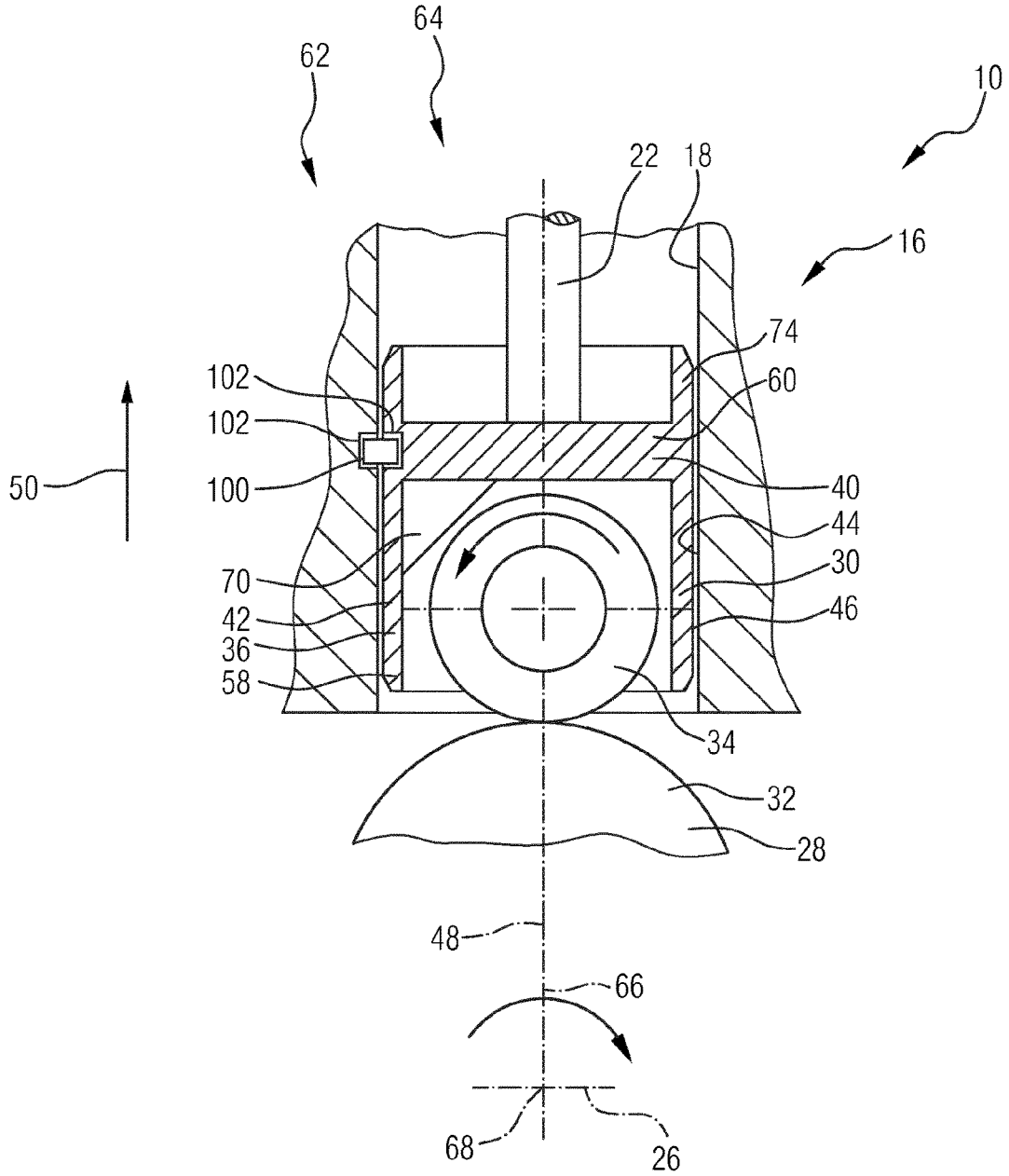
FIG. 11 shows a diagrammatic longitudinal sectional illustration of a roller plunger in accordance with FIG. 3 with an additional anti-rotation safeguard.

FIG. 11 shows an anti-rotation safeguard 98 in longitudinal section by way of example for the triangular unbalance mass 70 on the inner region 72 of the plunger 36, which anti-rotation safeguard 98 can also be used, however, in all other embodiments. The anti-rotation safeguard can be configured as a pinion 100 which is arranged either on the plunger guide bore 44 or on the plunger skirt 36 and engages into a recess 100 on the adjacent element (plunger guide bore 44 or roller plunger 30), in order thus to prevent the roller plunger 30 from rotating about its roller plunger axis 66.

In some embodiments, the asymmetrical plunger geometry results in an offset centroid 86 generating a moment for influencing the plunger kinematics. Moreover, this additional degree of freedom in the geometric design of the roller plunger 30 can provide further possibilities. In addition to the change in the forces themselves, the time of tilting or lifting up at the lower or upper end of the plunger guide bore 44 can also be optimized, in order to shift negative influences on the acceleration profile of the roller speed into an uncritical profile. Therefore, sudden slip between a surface 32 of the camshaft 26 and the roller 34, caused by tilting of the roller plunger 30, can be adjusted forward or backward, in order to move the angle as far as possible into an uncritical region of the stroke profile.

LIST OF DESIGNATIONS

10 High pressure pump
12 Fuel injection system
14 Internal combustion engine
16 Piston pump
18 Piston guide
20 Pump housing
20*a* Cylinder region
20*b* Lower housing region
22 Piston
24 Pressure space
25 Fuel
26 Camshaft
28 Cam
30 Roller plunger
32 Surface
34 Roller
36 Plunger skirt
38 Roller shoe
40 Crossmember
42 Circumferential wall
44 Plunger guide bore
46 Outer region
48 Plane of symmetry
50 Longitudinal extent
52 Circle radius
54 Circle center point
56 Median
58 Open end
60 Contact region
62 Geometry
64 Overall mass
66 Roller plunger axis
68 Axis
70 Unbalance mass
72 Inner region
74 Basic mass
76 First triangle leg
78 Part region, crossmember
80 Second triangle leg
82 Part region, circumferential wall
84 Length
86 Centroid
88 Projection
90 Notch
92 Cavity
94 First material
96 Second material
98 Anti-rotation safeguard
100 Journal
102 Recess
$F_{axial}$ Force in the axial direction
$F_{seitlich}$ Force in the lateral direction
$F_1$ Lateral force at the open end of the circumferential edge
$F_2$ Lateral force in the contact region of the crossmember with the circumferential wall
$F_{Masse}$ Acceleration force of the unbalance mass
$M_{Masse}$ Torque of the unbalance mass

What is claimed is:

1. A pump for a fuel injection system of an internal combustion engine, the pump comprising:

a pump housing including a piston guide and a plunger guide bore;

a piston for compressing a fuel, the piston guided in the piston guide; and a roller plunger including a plunger skirt and a roller, the roller plunger transferring a translational movement from a cam of a camshaft driven by the internal combustion engine to the piston;

the roller plunger guided to slide in the plunger guide bore along a roller plunger axis;

the plunger skirt including an outer region directed away from the roller and an inner region extending toward the roller and having a constant length measured along the roller plunger axis;

wherein the inner region of the plunger skirt includes a circumferential wall with a length extending along the roller plunger axis and a crossmember in contact with the piston and for mounting the roller so the roller is not in contact with the circumferential wall;

the plunger skirt comprising an overall mass distributed asymmetrically about the roller plunger axis.

2. The pump as claimed in claim 1, wherein an overall mass arranged on the crossmember or the circumferential wall and distributed asymmetrically about the roller plunger axis.

3. The pump as claimed in claim 2, wherein the overall mass of the plunger skirt comprises the sum of a basic mass of the plunger skirt configured symmetrically with respect to the roller plunger axis and an unbalance mass attached asymmetrically with respect to the roller plunger axis on an inner region of the plunger skirt, and wherein the unbalance mass is disposed in a contact region between the crossmember and the circumferential wall.

4. The pump as claimed in claim 3, wherein the unbalance mass is disposed in the plunger skirt and not in contact with the roller, the circumferential wall having a length parallel to the roller plunger axis, measured from a contact region with the crossmember to an open end opposite the contact region, and the unbalance mass extends from the contact region over half the length of the circumferential wall.

5. The pump as claimed claim 3, wherein the unbalance mass includes a triangular configuration including a first triangle leg formed of a part of the crossmember and a second triangle leg formed of a part of the circumferential wall.

6. The pump as claimed in claim 3, wherein the unbalance mass comprises from 10% to 100% of the basic mass.

7. The pump as claimed in claim 2, wherein the circumferential wall includes at least one notch.

8. The pump as claimed in claim 7, wherein the circumferential wall has a length parallel to the plunger guide bore, extending from a contact region with the crossmember to an open end opposite the contact region, and the notch extends from the open end over half the length of the circumferential wall.

9. The pump as claimed in claim 2, wherein the circumferential wall includes a cavity and the cavity is disposed on a third of the circumferential wall adjacent to the open end.

10. The pump as claimed in claim 2, wherein the roller plunger comprises at least two different materials having different density and arranged on the crossmember or the circumferential wall distributed asymmetrically about the roller plunger axis.

11. The pump as claimed in claim 3, wherein the unbalance mass is disposed in the plunger skirt and not in contact with the roller, the circumferential wall having a length parallel to the plunger guide bore, measured from a contact region with the crossmember to an open end opposite the contact region, and the unbalance mass extends from the contact region over a third of the length.

12. The pump as claimed in claim 3, wherein the unbalance mass is disposed in the plunger skirt and not in contact with the roller, the circumferential wall having a length parallel to the plunger guide bore, measured from a contact region with the crossmember to an open end opposite the contact region, and the unbalance mass extends from the contact region over a quarter of the length.

13. The pump as claimed claim 3, wherein at least one projection is arranged on the crossmember or the circumferential wall in the contact region.

14. The pump as claimed in claim 3, wherein the unbalance mass comprises from 20% to 50% of the basic mass.

15. The pump as claimed in claim 7, wherein the notch extends from the open end over a third of the length.

16. The pump as claimed in claim 7, wherein the notch extends from the open end over a quarter of the length.

* * * * *